United States Patent [19]

Wachendorf

[11] 3,986,326

[45] Oct. 19, 1976

[54] METHOD AND APPARATUS FOR PREVENTING YARN BREAKAGE IN RING SPINNING MACHINES

[75] Inventor: Friedrich Wachendorf, Eggestedt, Germany

[73] Assignee: Fried. Krupp Gesellschaft mit beschrankter Haftung, Essen, Germany

[22] Filed: Feb. 12, 1975

[21] Appl. No.: 549,210

[30] Foreign Application Priority Data

Mar. 29, 1974 Germany ..... 2415295

[52] U.S. Cl. ..... 57/54; 57/34 TT; 57/156

[51] Int. Cl.[2] ..... D01H 1/38; D01H 9/14

[58] Field of Search ..... 57/34 R, 34 TT, 54, 57/78, 156, 79, 52, 53

[56] References Cited

UNITED STATES PATENTS

| | | | |
|---|---|---|---|
| 2,798,356 | 7/1957 | Christiansson | 57/54 X |
| 3,067,566 | 12/1962 | Van Dreven et al. | 57/54 |
| 3,075,342 | 1/1967 | Lohest et al. | 57/54 |
| 3,097,475 | 7/1963 | Hooper et al. | 57/99 |
| 3,231,309 | 1/1966 | Pray et al. | 57/54 X |
| 3,256,683 | 6/1966 | Andersen et al. | 57/54 |

*Primary Examiner*—John Petrakes
*Attorney, Agent, or Firm*—Spencer & Kaye

[57] ABSTRACT

In a ring spinning machine, for preventing the presence of a loose yarn end lying on the yarn upstream of the traveler upon resumption of spinning after a full bobbin is replaced by an empty bobbin on the spindle, the ring rail, while the spindle is stationary, is raised to a position above the spin-start position and thereafter the rotation of the spindle is restarted for initiating a normal cop building operation, during the course of which the ring rail is reciprocated between the spin-start position and a highest spinning position.

12 Claims, 1 Drawing Figure

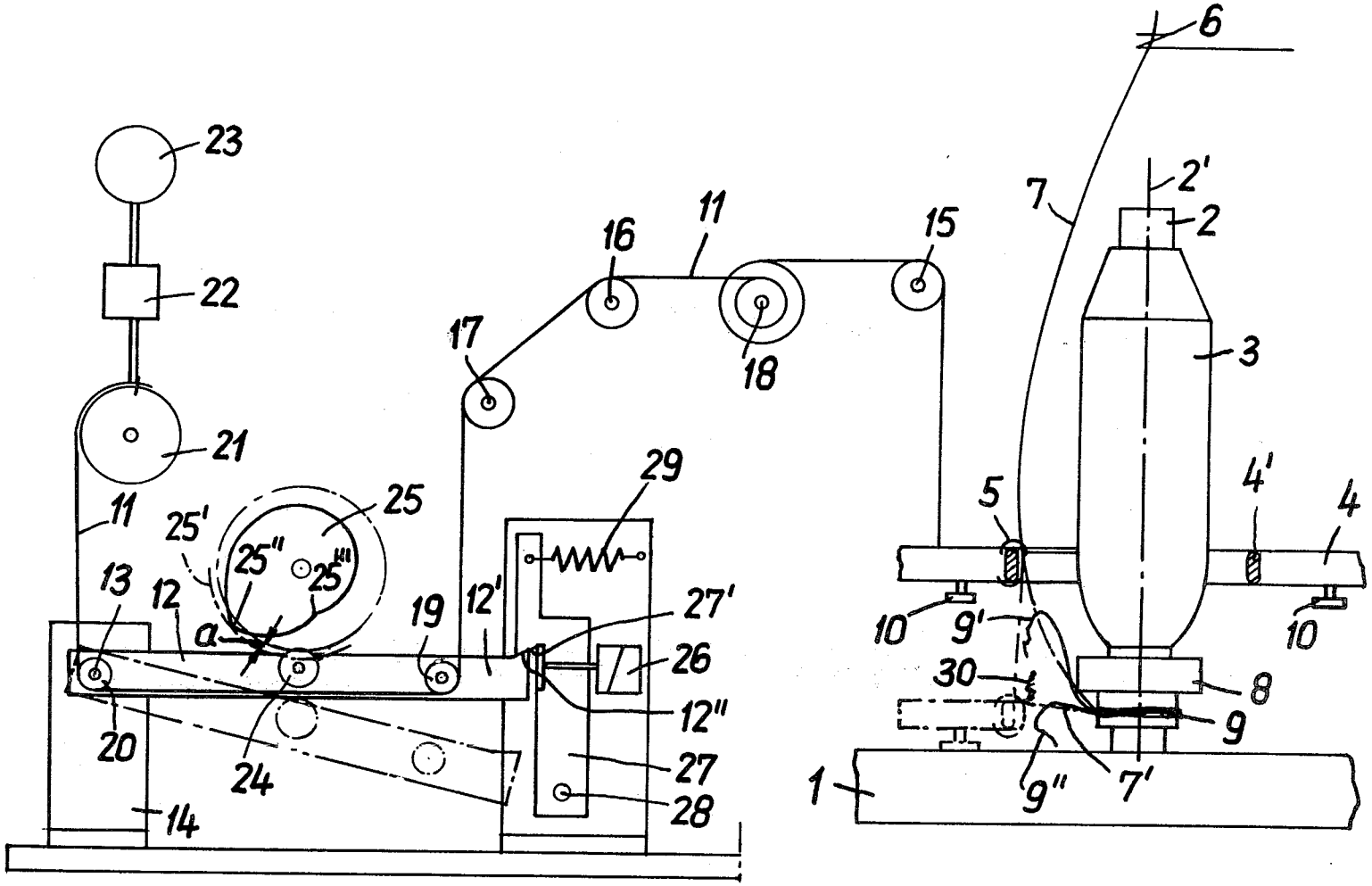
1
2
2'
3
4
4'
5
6
7
7'
8
9
9'
9''
10
11
12
12'
12''
13
14
15
16
17
18
19
20
21
22
23
24
25
25'
25''
25'''
26
27
27'
28
29
30
a

METHOD AND APPARATUS FOR PREVENTING YARN BREAKAGE IN RING SPINNING MACHINES

BACKGROUND OF THE INVENTION

This invention relates to a method and apparatus for substantially eliminating yarn breakage in ring spinning machines upon resumption of spinning after bobbin exchange. The invention pertains in particular to those ring spinning machines which are equipped with an automatic doffing device and in which the control of the ring rail motion is effected by means of a lifter arm which is moved up and down by means of a rotating, usually heart-shaped cam disc connected to the lifter arm. The automatic doffing device is conventionally mounted on the ring spinning machine for mechanically removing the completed yarn package and subsequently inserting an empty bobbin on the spindle.

In ring spinning, after completion of a cop (yarn package), the yarn is conventionally guided by the ring rail to a location underneath the cop to apply a few yarn turns to the underwinding (or waste) spool forming part of the spindle. The result of this step is that the yarn course is not disturbed as the cop is removed, that is, the yarn remains in the guide wire, in the traveler and on the underwinding spool. Thus, when the cop is removed, the yarn is to break between the cop and the underwinding spool. For resuming the spinning operation, a new bobbin is inserted on the empty spindle after removal of the cop and the ring spinning machine is restarted, the ring rail is lifted from the underwinding position and thus the yarn is guided onto the new bobbin.

When practicing the above-outlined process, it often occurs, however, that the loose end of the yarn falls over the positioned yarn in the underwinding position of the ring rail. Further, when the ring spinning machine is stopped, as a result of the slackening of the positioned yarn, often loops are formed which may also appear upstream of the traveler when the ring rail is in the underwinding position. When the spinning operation is resumed, these loops, as well as the overhanging loose yarn end, have to be drawn through the traveler. This, in general, leads to yarn breakage, since the ring rail — the motion of which is controlled by the eccentric, heart-shaped cam disc — is lifted only slightly as the cam disc is set in motion.

SUMMARY OF THE INVENTION

It is an object of the invention to provide an improved method and apparatus of the above-outlined type with which yarn breakages upon the resumption of spinning are substantially eliminated.

By virtue of the invention, it is thus sought to eliminate, on the one hand, that the loose yarn ends fall on the yarn zone upstream of the traveler and, on the other hand, it is sought to ensure that the loops formed as the ring spinning machine is stopped, are located preferably in the zone between the traveler and the underwinding spool and thus do not obstruct the resumption of the spinning.

These objects and others to become apparent as the specification progresses, are accomplished by the invention, according to which, briefly stated, the ring rail of the ring spinning machine, while the spindle is stationary, is raised to a position above the spin-start position and thereafter the rotation of the spindle is restarted for initiating a normal cop building operation, during the course of which the ring rail is reciprocated between the spin-start position and a highest spinning position.

BRIEF DESCRIPTION OF THE DRAWING

The sole FIGURE illustrates a preferred embodiment of the invention in a schematic side elevational view.

DESCRIPTION OF THE PREFERRED EMBODIMENT

The ring spinning machine illustrated in the FIGURE comprises the following spinning components:

A spindle 2 which is rotatably supported on a spindle rail 1 and which receives a bobbin on which the cop 3 is formed. A ring rail 4, which is movable parallel to the spindle axis 2', supports a ring 4' on which orbits a traveler 5 about the spindle axis 2'. The yarn 7 extending from a draft mechanism (not shown), is threaded through a guide wire 6 and is guided to the traveler 5.

Under the cop 3 there is located an underwinding spool 8 on which there is wound the waste yarn 9 having a loose end 9'. The spindle whorl which is disposed in the zone of the spindle rail 1 and which is engaged by the spindle-rotating mechanism, is not illustrated for the sake of clarity. The ring rail 4 is provided at its underside with set screws 10 by means of which the ring rail 4 engages the spindle rail 1 in the underwinding position (illustrated fragmentarily in dash-dot lines).

The ring rail 4 is, by means of a cable or strap 11, connected with a lifter arm 12 which is swingably supported about a pivot 13 held, in turn, in an upright support 14. The cable 11 is guided by means of deflecting rollers 15, 16 and 17. Between the deflecting rollers 15 and 16 there is arranged a transmission ratio converter 18 comprising two drums of different diameters. As it may be observed from the FIGURE, a clockwise pivotal motion of the lifter arm 12 will cause an upward shift of the ring rail 4.

The cable 11 is attached to a cable pulley 21 and is trained about rollers 19 and 20 which, respectively, are arranged adjacent the free end portion and in the pivotal zone of the lifter arm 12. The cable pulley 21 is connected with an underwinding motor 23 through an underwinding drive 22. By virtue of this arrangement the ring rail 4, when the cable pulley 21 is rotated counterclockwise by the underwinding drive 22, is lowered into the underwinding position independently from the position of the lifter arm 12. In the underwinding position the set screws 10 engage the top edge face of the spindle rail 1.

Prior to starting the spinning operation, the lifter arm 12 is relaxed to such an extent that the follower roller 24 will be disposed at a distance of approximately 10 mm outside a circle 25' which is described by the tip 25'' of the cam disc 25. In this position of the lifter arm 12 (shown in dash-dot lines), the ring rail 4 engages the spindle rail 1 with the set screws 10.

When spinning is to be started, the lifter arm 12 is raised by means of the underwinding drive assembly 21, 22, 23 and in this manner the ring rail 4 is brought into the spin-start position above the spindle rail 1.

During the spinning operation the ring rail 4 alternately moves into a highest and a lowest position, dependent on whether the follower roller 24 engages the peak 25'' or the deepest point 25''' of the cam disc 25.

Adjacent the free terminus 12' of the lifter arm 12 there is disposed a detent 27 which is swingably supported by a stationary pivot 28. An electromagnet 26 is connected to the detent 27 to move the latter, when the electromagnet 26 is energized, towards the lifter arm 12. A return spring 29 is connected to the detent 27 for urging the latter in a direction away from the lifter arm 12.

Before resumption of the spinning operation following bobbin exchange, the electromagnet 26 is energized, whereby the detent 27 swings counterclockwise against the force of the return spring 29, into the travelling path of the lifter arm 12 to assume an operative position. Thus, as it may be well observed in the FIGURE, a wedge-like terminus 12'' of the end portion 12' of the lifter arm 12 will abut against a counterface 27' of the detent 27, preventing the lifter arm 12 from moving higher than a predetermined position regardless of the position of the cam disc 25. In this highest position of the lifter arm 12 (and thus the lowest position of the ring rail 4) for the resumption of spinning, the highest point of the follower roller 24 projects by a distance *a* into the circle 25' described by the cam disc 25. As the cam disc 25 passes through the lower dead center in which the peak 25'' of the cam disc 25 engages and displaces the follower roller 24, the lifter arm 12 is pushed downwardly through the distance *a* and thus the wedge-shaped terminus 12'' clears the wedge-shaped counterface 27'. Since the electromagnet 26 is, by this time, in a de-energized state (the detent 27 is maintained in the operative state by the lifter arm 12 urged continuously upwardly by the ring rail 4), the return spring 29 pivots the detent 27 clockwise into its inoperative position, permitting the lifter arm 12 to normally follow, with the follower roller 24, the contour of the cam disc 25, thus initiating the normal spinning process.

Thus, according to the invention, the restart of the spinning occurs in the normal restart position of the cable pulley 21, while the lifter arm 12 is, by means of an interengagement with the detent 27, prevented from causing a normal lowering movement of the ring rail 4 during the yarn winding in the restart phase of the spinning.

The advantage accomplished by the invention by virtue of the elevated position of the ring rail 4 during restart of the spinning resides in the fact that, on the one hand, the loose end 9'' cannot drop onto the yarn portion 7' and, on the other hand, upon stopping the ring spinning machine, the loops 30 advantageously are formed in the zone between the traveler 5 and the underwinding spool 8 and thus do not adversely affect the operation.

The broadest scope of the invention may thus be summarized as follows:

During normal yarn package building, the ring rail 4 is vertically reciprocated between highest and lowest spinning positions, while the yarn 7 is wound on the yarn package 3 guided by the orbiting traveler 5.

When the yarn package 3 is completed, the ring rail 4 is lowered below its lowest spinning position into the underwinding position. While the spindle 2 is still rotating, the traveler 5 now orbits about the underwinding spool 8 for providing a number of yarn turns thereon.

Thereafter, the rotation of the spindle 2 is stopped.

While the spindle 2 is at a standstill, the completed yarn package is removed from the spindle. This operation causes yarn breakage between the underwinding spool 8 and the axially outwardly moving yarn package 3.

Subsequently, an empty bobbin is inserted on the spindle.

The above-outlined steps are all conventional.

According to the invention, while the spindle is at a standstill, that is, prior to restarting its rotation for initiating the building of a new yarn package on the empty bobbin, the ring rail 4 is raised to a position which is above the lowest normal spinning position (conventional spin-start position).

In this manner, when the normal yarn package building operation is restarted, no loose yarn is positioned on the yarn portion upstream of the traveler 5. Thus, in contradistinction to ring rail machines of the prior art, when the spinning is restarted, no loose yarn end has to be drawn through the traveler 5, whereby a principal cause of yarn breakage is substantially eliminated. Similarly, there will substantially be no loop formation upstream of the traveler 5 when the yarn package building is restarted.

It will be understood that the above description of the present invention is susceptible to various modifications, changes and adaptations, and the same are intended to be comprehended within the meaning and range of equivalents of the appended claims.

I claim:

1. A method of spinning on a ring spinning machine with a substantial reduction of yarn breakages upon resumption of spinning subsequent to the removal of a full bobbin and the insertion of an empty bobbin, wherein during normal spinning operation, a lifter arm connected to a ring rail is moved up and down by a rotating cam disc for vertically reciprocating the ring rail between a spin-start position and a highest spinning position, comprising the steps of a. immobilizing, immediately prior to the resumption of spinning, the lifter arm in a predetermined position for maintaining stationary the ring rail above the spin-start position; and b. releasing the lifter arm by the cam disc after not more than one revolution of the latter from the moment of immobilization of the lifter arm for lowering the ring rail into the spin-start position.

2. A method as defined in claim 1, wherein the cam disc determines an upper and a lower dead center for the motion of the lifter arm; and wherein step (a) includes the immobilization of the lifter arm above said lower dead center.

3. In a method of spinning on a ring spinning machine with a substantial reduction of yarn breakages upon resumption of spinning subsequent to the removal of a full bobbin and the insertion of an empty bobbin, including the consecutive steps of vertically reciprocating the ring rail of the ring spinning machine between a spin-start position and a highest spinning position during normal cop building; lowering the ring rail into an underwinding position upon completion of the cop building for winding the yarn on an underwinding spool; stopping the rotation of the spindle of the ring spinning machine; removing the completed cop from the spindle whereby the yarn is broken between the cop and the underwinding spool; and inserting an empty bobbin on the spindle; the improvement comprising the step of a. raising the ring rail, while the spindle is stationary, to a position which is above the spin-start position; and b. subsequent to step (a), restarting the rotation of the spindle for initiating normal cop building on the empty bobbin.

4. In a ring spinning machine including a spindle; a ring rail movable up and down adjacent the spindle in a direction parallel to the spindle axis; a ring supported by the ring rail and surrounding the spindle; a traveler supported by the ring for orbital movement about the spindle; a lifter arm; connecting means for coupling the lifter arm to the ring rail; and drive means for reciprocating the lifter arm between upper and lower dead center positions for effecting a reciprocating movement of the ring rail between a spin-start position and a highest spinning position; the improvement comprising:

a. a detent means having an operative position in which it immobilizes said lifter arm between said upper and lower dead centers for immobilizing said ring rail in a position above said spin-start position; said detent means having an inoperative position in which it has no effect on said lifter arm; and b. actuating means connected to said detent means for moving the latter from one of its positions into the other.

5. In a method of spinning on a ring spinning machine with a substantial reduction of yarn breakages upon resumption of spinning subsequent to the removal of a full bobbin and the insertion of an empty bobbin, including the consecutive steps of vertically reciprocating the ring rail of the ring spinning machine between a spin-start position and a highest spinning position during normal cop building; lowering the ring rail into an underwinding position upon completion of the cop building for winding the yarn on an underwinding spool; stopping the rotation of the spindle of the ring spinning machine; removing the completed cop from the spindle whereby the yarn is broken between the cop and the underwinding spool; and inserting an empty bobbin on the spindle; the improvement comprising the following steps:

a. immediately prior to restarting the rotation of the spindle for initiating normal cop building on the empty bobbin, raising the ring rail from the underwinding position to an elevated position which is above the spin-start position;

b. upon completion of step (a), temporarily maintaining stationary the ring rail in said elevated position; and c. subsequent to the step (b), restarting the rotation of the spindle for initiating normal cop building on the empty bobbin.

6. A method as defined in claim 5, wherein the ring rail is moved vertically by a lifter arm, said step (b) is performed by temporarily blocking the motion of said lifter arm.

7. A method as defined in claim 5, wherein said elevated position into which the ring rail is raised in step (a), is situated between the spin-start position and the highest spinning position.

8. A method as defined in claim 5, further comprising the step of lowering, subsequent to the completion of step (b) and prior to step (c), said ring rail in the start-spin position.

9. In a ring spinning machine including a spindle; a ring rail movable up and down adjacent the spindle in a direction parallel to the spindle axis; a ring supported by the ring rail and surrounding the spindle; a traveler supported by the ring for orbital movement about the spindle; a lifter arm; connecting means for coupling the lifter arm to the ring rail for effecting downward movement of said ring rail during upward movement of said lifter arm and for effecting upward movement of said ring rail upon downward movement of said lifter arm; and drive means for reciprocating the lifter arm between upper and lower dead center positions for effecting a reciprocating movement of the ring rail between a spin-start position and a highest spinning position; the drive means including a rotarily supported cam disc in engagement with the lifter arm; the improvement comprising:

a. a detent means having an operative position in which it immobilizes said lifter arm between said upper and lower dead centers for immobilizing said ring rail in a position above said spin-start position; said detent means having an inoperative position in which it has no effect on said lifter arm;

b. actuating means connected to said detent means for moving the latter from one of its positions into the other; said actuating means including a return spring attached to said detent means for urging it from said operative position into said inoperative position and an energizable and de-energizable force-exerting means for urging said detent means into said operative position; said force-exerting means, when energized, overcoming the force of said return spring; and c. cooperating means on said lifter arm and said detent means for maintaining said detent means in said operative position in the de-energized state of said force-exerting means; said cooperating means being disengaged and said detent means being displaced by said return spring to said inoperative position upon movement of said lifter arm by said drive means from the immobilized position towards said lower dead center.

10. A ring spinning machine as defined in claim 9, wherein said cooperating means include complemental wedge faces on said lifter arm and said detent means; said wedge faces being maintained in an interengaging relationship by the weight of said ring rail exerting an upward force on said lifter arm; said upward force being overcome by said drive means.

11. A ring spinning machine as defined in claim 9, said lifter arm having a first end attached to stationary pivot means and a second end cooperating with said detent means.

12. A ring spinning machine as defined in claim 9, wherein said force-exerting means includes an electromagnet.

* * * * *